US008857565B2

(12) United States Patent
Harrison et al.

(10) Patent No.: US 8,857,565 B2
(45) Date of Patent: Oct. 14, 2014

(54) METHOD FOR MAKING ACOUSTICAL PANELS WITH A THREE-DIMENSIONAL SURFACE

(76) Inventors: Jacque S. Harrison, Frederick, CO (US); Donald W. Harrison, Frederick, CO (US)

( * ) Notice: Subject to any disclaimer, the term of this patent is extended or adjusted under 35 U.S.C. 154(b) by 439 days.

(21) Appl. No.: 12/986,608

(22) Filed: Jan. 7, 2011

(65) Prior Publication Data

US 2012/0175184 A1 Jul. 12, 2012

(51) Int. Cl.

| | |
|---|---|
| ***E04B 1/82*** | (2006.01) |
| ***G10K 11/168*** | (2006.01) |
| ***B44C 3/02*** | (2006.01) |
| ***B44C 5/04*** | (2006.01) |
| ***E04B 1/86*** | (2006.01) |
| *E04B 1/74* | (2006.01) |
| *G10K 11/16* | (2006.01) |
| *B44C 3/12* | (2006.01) |
| *E04B 1/84* | (2006.01) |

(52) U.S. Cl.

CPC ..... *B44C 3/025* (2013.01); *B44C 5/0461* (2013.01); *E04B 1/86* (2013.01); *E04B 2001/8414* (2013.01); *E04B 2001/8461* (2013.01)

USPC ..... 181/290; 181/291; 181/296; 156/63; 156/285

(58) Field of Classification Search

CPC ..... B44C 3/025; B44C 5/0461; B44C 3/12; B44C 3/082; B44C 3/085; E04B 1/86; E04B 2001/8461; E04B 2001/8414; E04B 1/84; B29C 65/48; B32B 37/10; B32B 37/1018; B32B 37/12

USPC ..... 181/290, 291, 296, 284; 156/94, 213, 156/286, 63, 60, 212, 285

See application file for complete search history.

(56) References Cited

U.S. PATENT DOCUMENTS

| | | | | | |
|---|---|---|---|---|---|
| 1,928,034 | A | * | 9/1933 | Schulstadt | 428/49 |
| 2,140,210 | A | * | 12/1938 | Schenk | 181/291 |
| 2,355,568 | A | * | 8/1944 | Smith | 428/47 |
| 2,652,126 | A | * | 9/1953 | Mazer | 181/293 |
| 3,255,843 | A | * | 6/1966 | MacDonald | 181/291 |
| 3,328,228 | A | | 6/1967 | Ford et al. | |
| 3,357,516 | A | | 12/1967 | Cadotte et al. | |
| 3,398,811 | A | * | 8/1968 | Muller | 181/291 |
| 3,553,062 | A | * | 1/1971 | Berlin | 428/21 |
| 3,963,847 | A | | 6/1976 | Norgard | |
| 4,056,161 | A | | 11/1977 | Allen, Jr. | |
| 4,066,805 | A | | 1/1978 | Shenk | |
| 4,146,999 | A | * | 4/1979 | Petrovec et al. | 52/145 |
| 4,278,146 | A | * | 7/1981 | Lerner et al. | 181/210 |
| 4,330,046 | A | * | 5/1982 | Lerner et al. | 181/210 |
| 4,428,454 | A | * | 1/1984 | Capaul et al. | 181/290 |
| 4,487,793 | A | | 12/1984 | Haines, Jr. et al. | |
| 4,585,685 | A | | 4/1986 | Forry et al. | |

(Continued)

FOREIGN PATENT DOCUMENTS

GB 970931 * 10/1960

*Primary Examiner* — Edgardo San Martin

(74) *Attorney, Agent, or Firm* — Dorr, Carson & Birney, P.C.

(57) ABSTRACT

A method for producing acoustical panels with a three-dimensional surface bonds stacks of design pieces to a flat panel. A layer of adhesive is applied over the assembly, and then a fabric layer is applied over the assembly to bond the fabric over the panel and design pieces.

7 Claims, 10 Drawing Sheets

(56) References Cited

U.S. PATENT DOCUMENTS

| | | | | | |
|---|---|---|---|---|---|
| 4,666,540 | A | | 5/1987 | Halls | |
| 4,740,257 | A | | 4/1988 | Halls et al. | |
| 4,786,543 | A | | 11/1988 | Ferm | |
| 4,807,411 | A | | 2/1989 | Capaul | |
| 4,821,839 | A | * | 4/1989 | D'Antonio et al. | 181/198 |
| 4,824,729 | A | * | 4/1989 | Livi | 428/428 |
| 4,842,097 | A | | 6/1989 | Woodward et al. | |
| 4,894,102 | A | | 1/1990 | Halls et al. | |
| 4,960,184 | A | | 10/1990 | Woodward et al. | |
| 5,009,043 | A | | 4/1991 | Kurrasch | |
| 5,135,073 | A | | 8/1992 | Nelson | |
| 5,181,745 | A | * | 1/1993 | Jacobsen et al. | 283/94 |
| 5,579,614 | A | * | 12/1996 | Dorn | 52/144 |
| 5,652,031 | A | * | 7/1997 | Commanda | 428/13 |
| 5,658,621 | A | * | 8/1997 | Sohn | 428/24 |
| 5,916,843 | A | * | 6/1999 | Weller | 503/227 |
| 6,332,941 | B1 | * | 12/2001 | Council et al. | 156/230 |
| 6,403,195 | B1 | * | 6/2002 | Montagna et al. | 428/71 |
| 6,610,160 | B2 | | 8/2003 | Harrison | |
| 6,793,037 | B1 | * | 9/2004 | Babuke et al. | 181/293 |
| 7,063,184 | B1 | * | 6/2006 | Johnson | 181/290 |
| 7,070,848 | B2 | * | 7/2006 | Campbell | 428/137 |
| 7,434,660 | B2 | * | 10/2008 | Yamagiwa et al. | 181/293 |
| 7,682,476 | B2 | * | 3/2010 | Sutton | 156/250 |
| 7,703,575 | B2 | * | 4/2010 | Berger et al. | 181/293 |
| 8,695,758 | B2 | * | 4/2014 | Fushiki | 181/290 |
| 2005/0263044 | A1 | * | 12/2005 | Bearse et al. | 108/57.25 |
| 2009/0058070 | A1 | * | 3/2009 | Nagorneva | 281/38 |
| 2009/0178882 | A1 | * | 7/2009 | Johnson | 181/286 |
| 2009/0246436 | A1 | * | 10/2009 | Gorin et al. | 428/39 |

* cited by examiner

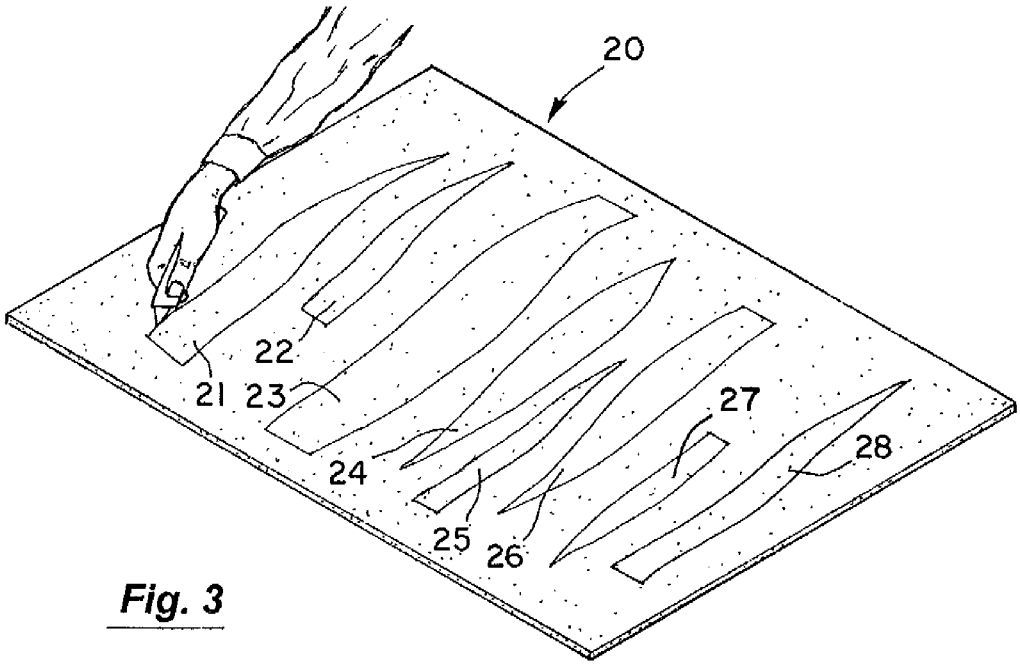
Fig. 3
Fig. 4
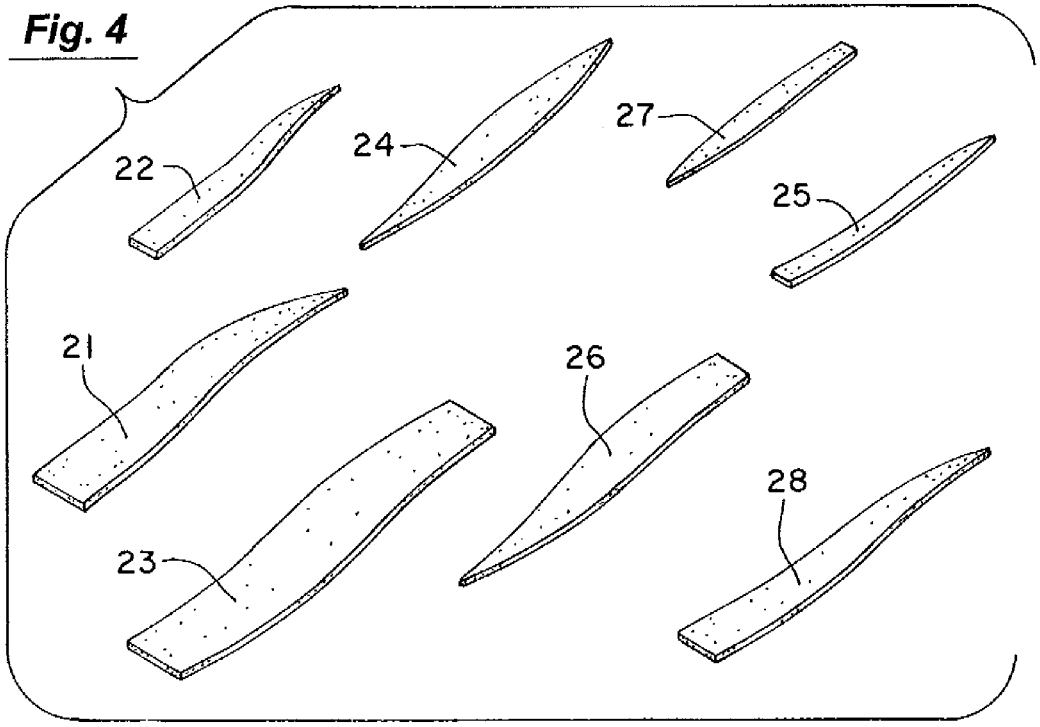

Fig. 5
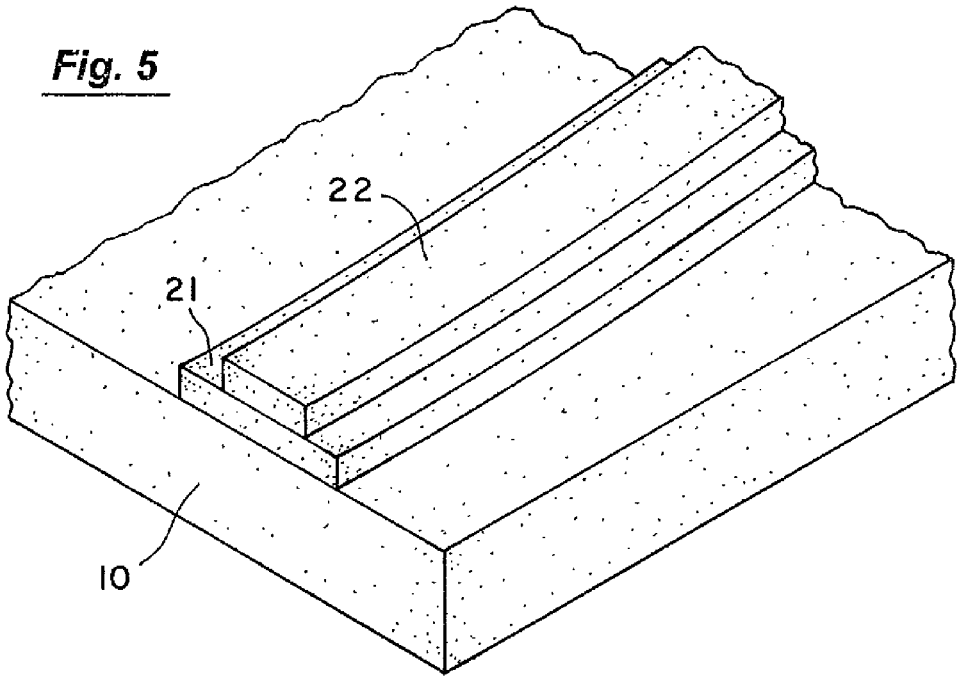
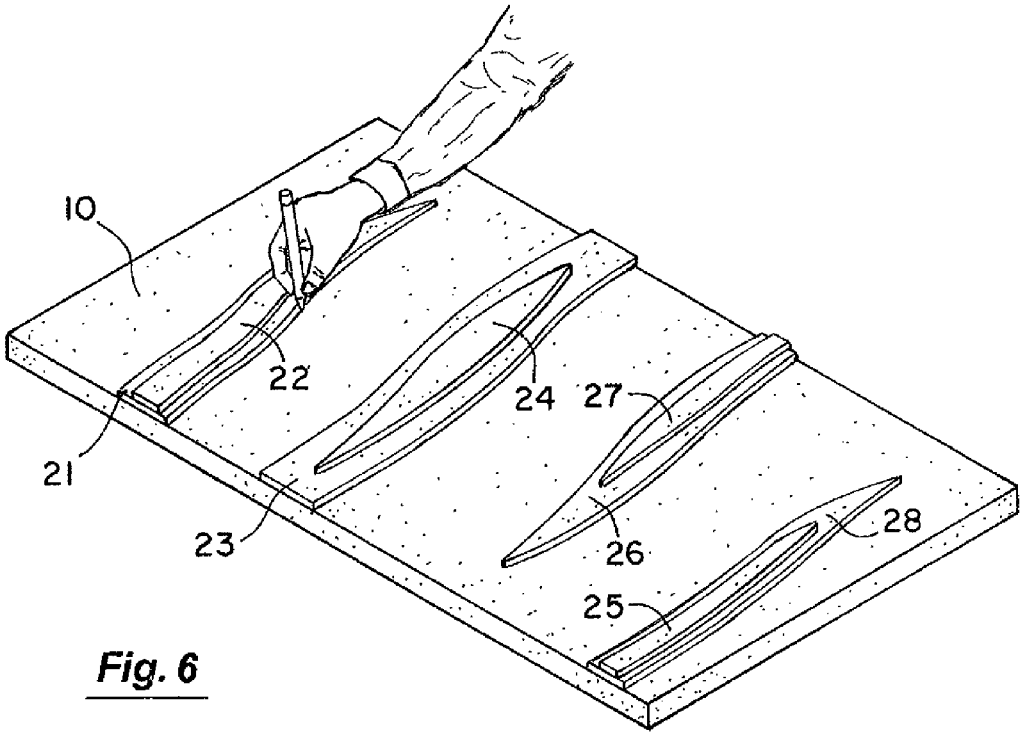
Fig. 6

Fig. 8
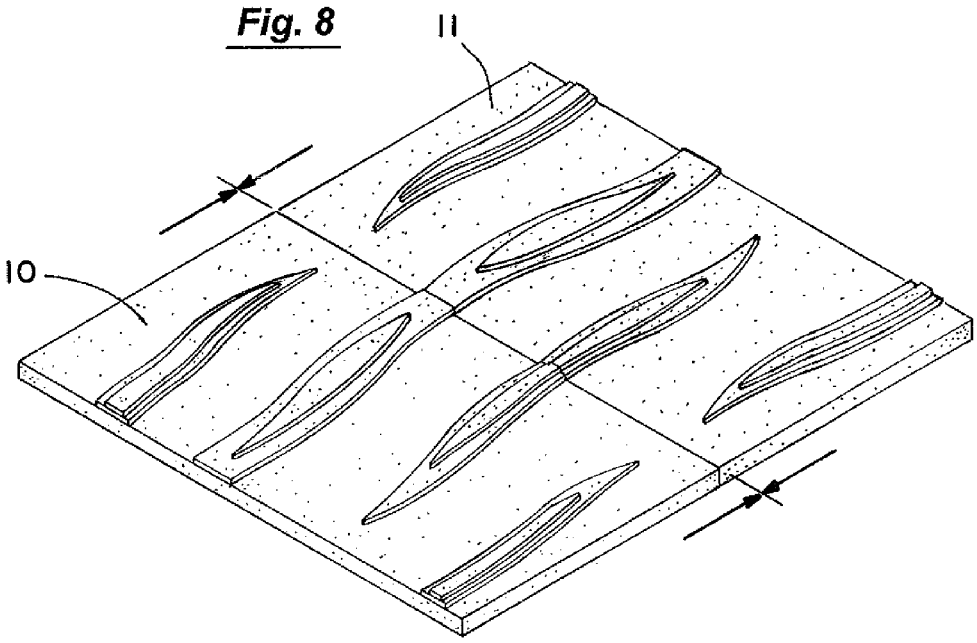
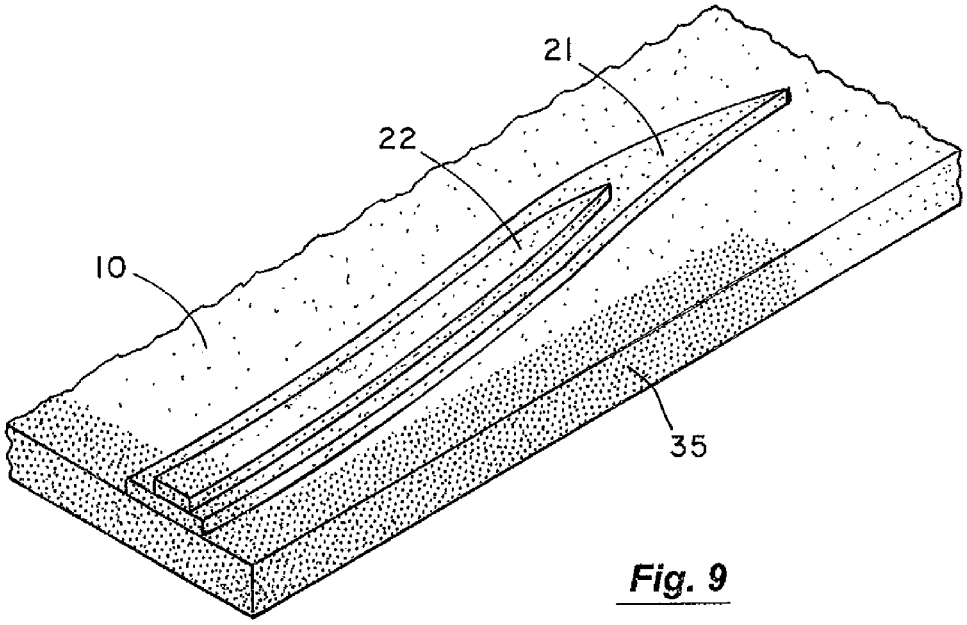
Fig. 9

METHOD FOR MAKING ACOUSTICAL PANELS WITH A THREE-DIMENSIONAL SURFACE

BACKGROUND OF THE INVENTION

1.Field of the Invention

The present invention relates generally to the field of acoustical panels. More specifically, the present invention discloses a method for making acoustical panels with a three-dimensional surface.

2. Statement of the Problem

Acoustical panels have been used for many years in a variety of fields of use. For example, many acoustical panels are used in suspended ceilings, or as ceiling panels or wall panels. The exposed surfaces of most acoustical panels are substantially flat, although many are texturized or perforated on a fine scale to provide an aesthetically-pleasing appearance.

Some acoustical panels have been made with a three-dimensional surface by molding, embossing or cutting away portions of the panel surface. However, these techniques have inherent limitations in that only so much material can be removed, and the panel thickness can only be reduced to a limited degree without jeopardizing the structural properties of the resulting acoustical panel. Thus, the range of depth and contour of the three-dimensional surfaces that can be formed with such techniques is very limited.

Solution to the Problem

The present invention addresses the shortcomings of the prior art in this field by employing a process of bonding design pieces to the face of a flat panel to build up a desired three-dimensional pattern, and then applying a fabric cover layer over the assembly. This approach allows three-dimensional patterns of virtually any complexity and depth to be created without jeopardizing the structural properties of the panel.

SUMMARY OF THE INVENTION

This invention provides a method for producing acoustical panels with a three-dimensional surface by bonding stacks of design pieces to a flat panel, applying a layer of adhesive over the assembly, and then applying a fabric layer over the assembly (e.g., drawn down by suction) to bond the fabric over the panel and design pieces.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a perspective view showing the design pieces 21-28 from FIG. 2 being cut out.

FIG. 4 is a perspective view showing the design pieces 21-28 laid out after cutting.

FIG. 5 is a detail perspective view showing two stacked design pieces 21, 22 abutting the edge of an acoustical panel 10.

FIG. 6 is a perspective view showing the layout of the design being marked on an acoustical panel 10 for placement of the design pieces 21-28.

FIG. 8 is a perspective view showing the design pieces bonded to acoustical panels 10 and 11.

FIG. 9 is a detail perspective view showing hardening of the edges of the assembled panel (i.e., the shaded area).

DETAILED DESCRIPTION OF THE INVENTION

Figure 1:
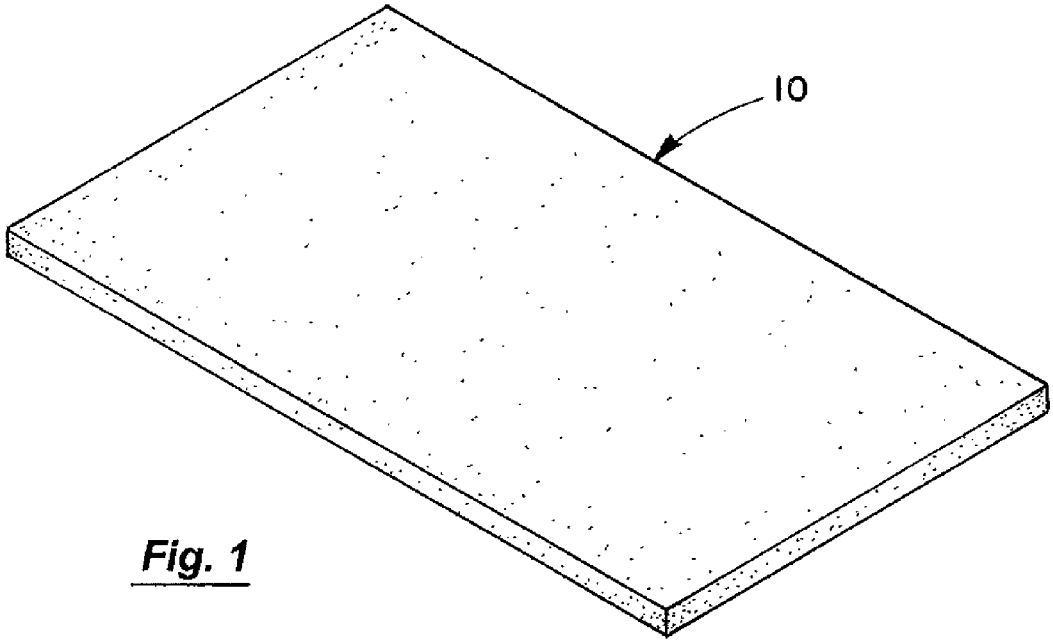
FIG. 1 is a perspective view of a flat acoustical panel 10.

Turning to FIG. 1, a perspective view is provided of a flat acoustical panel 10. This panel 10 serves as the base or substrate for the present invention. The panel 10 can be made of any conventional material suitable for its intended use, such as fiberglass. Optionally, the acoustical panel 10 should be air-permeable if the present method employs suction to apply a fabric layer, as will be discussed in detail below.

Figure 2:
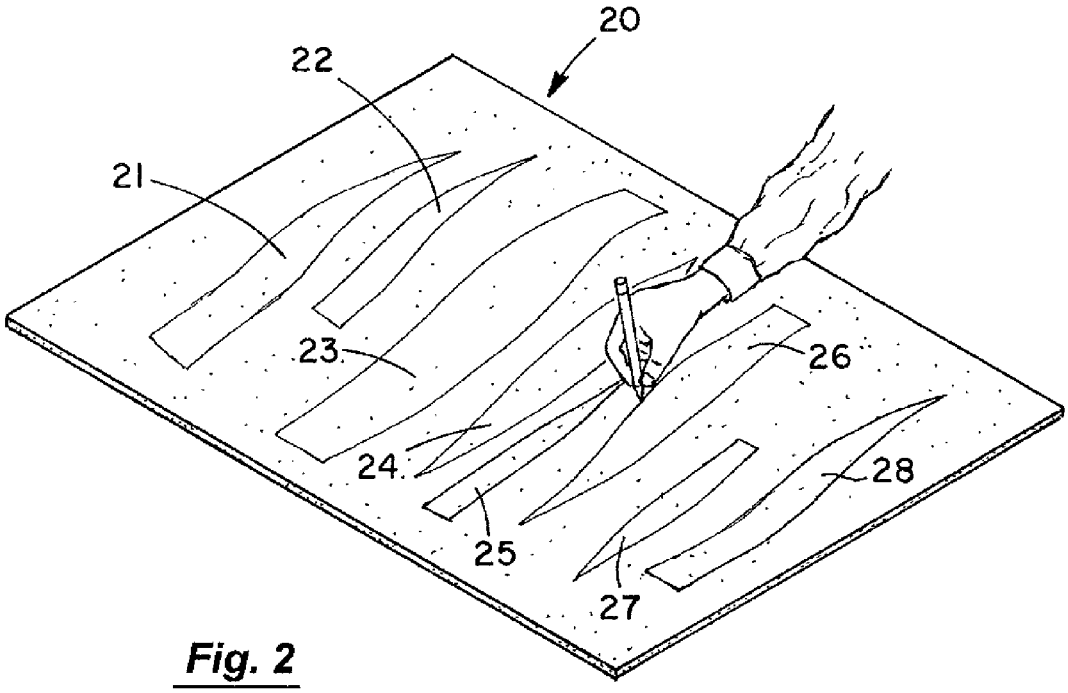
FIG. 2 is a perspective view showing design pieces 21-28 for the three-dimensional surface being marked out.

FIG. 2 is a perspective view showing design pieces 21-28 for creating the three-dimensional surface being marked out on a fiberglass board 20. FIG. 3 shows these design pieces 21-28 being cut out. The pieces 21-28 are laid out after cutting in FIG. 4. The design pieces 21-28 are then used in constructing raised three-dimensional surfaces on the flat panel 10. The design pieces 21-28 can either be placed singly atop the panel 10, or they can be stacked to any desired height on the panel 10. For example, FIG. 5 shows two design pieces 21 and 22 stacked on a panel 10 to create a three-dimensional surface with a visual effect similar to a contour map. It should be understood that the design pieces can have any desired thicknesses, dimensions or cross-sectional shapes to create aesthetically pleasing three-dimensional surfaces.

Figure 7:
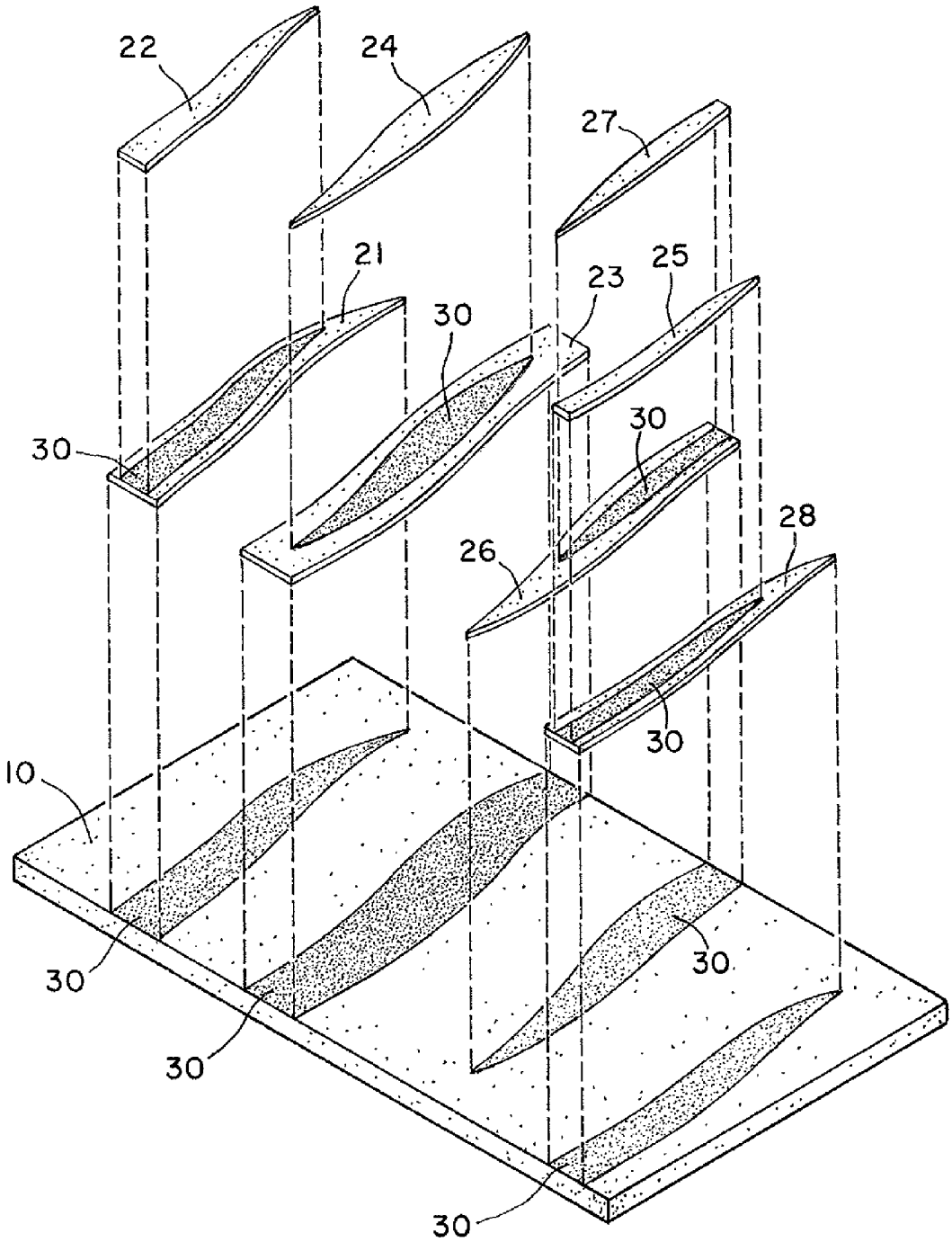
FIG. 7 is an exploded perspective view showing the design pieces 21-28 being placed on the acoustical panel 10. The shaded areas represent adhesive 30 placement.

After the design pieces 21-28 have been cut out, their proper placement can be marked on the panel 10 for assembly. FIG. 6 is a perspective view showing the layout of the design being marked on a panel 10 for placement of the design pieces 21-28. The design pieces 21-28 are then bonded with adhesive 30 to the panel 10 and to each other as illustrated in FIG. 7 to build up the desired three-dimensional surface on the panel 10. This design can extend over multiple panels 10, 11. For example, FIG. 8 is a perspective view showing the design pieces bonded to two acoustical panels 10, 11 to create a continuous three-dimensional design. Optionally, the exposed edges of the panel 10 and design pieces 21-28 can be hardened by applying a hardening material 35 (e.g., epoxy), as shown in FIG. 9, to increase structural strength and reduce the risk of damage of the edges of the panel assembly. Reinforcing material (e.g., thin sheets of rigid paper, cardboard or particle board) can also be bonded or attached to the edges of the panel 10 and/or design pieces 21-28.

Figure 10:
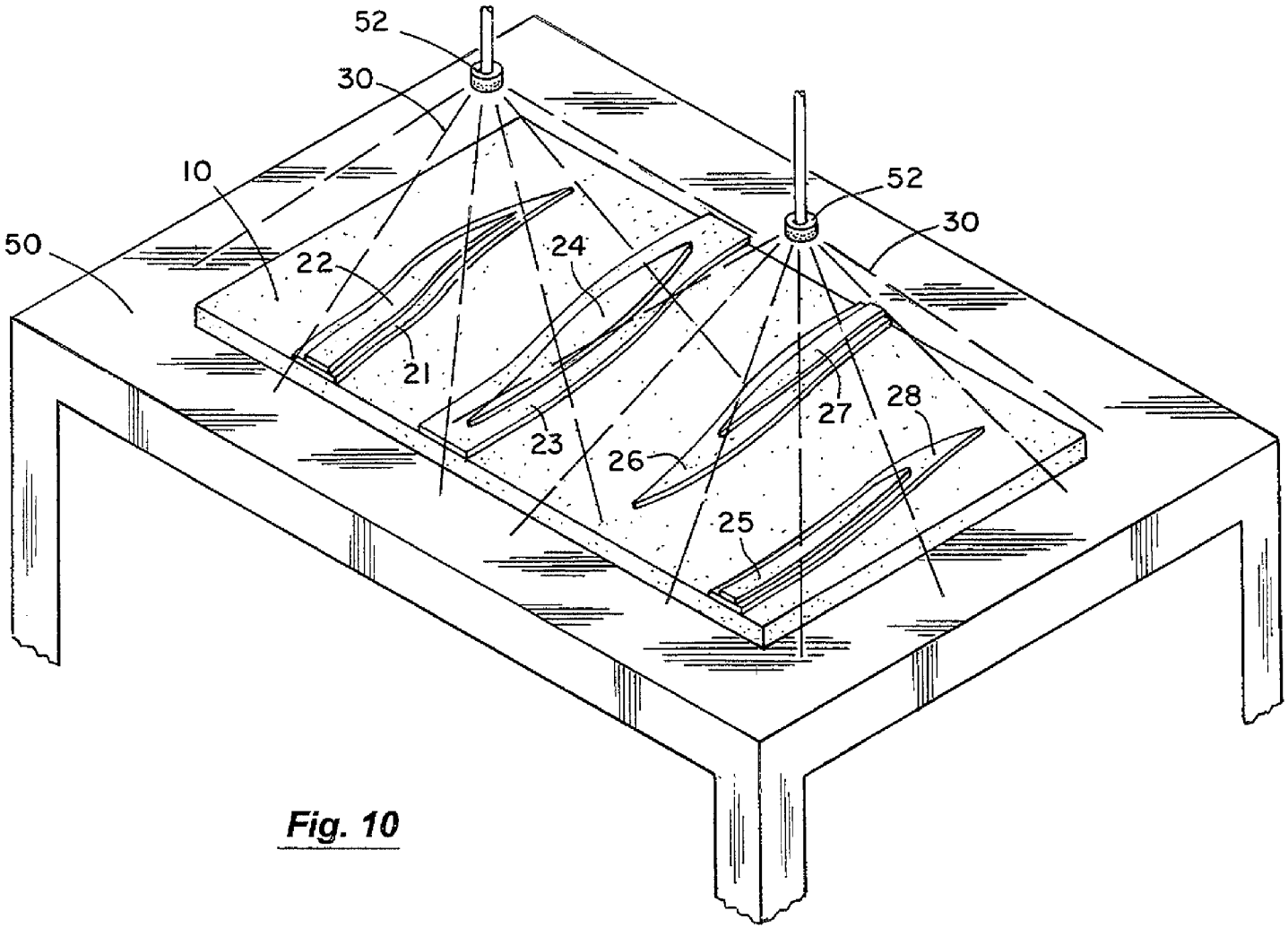
FIG. 10 is a perspective view showing the panel 10 in a spray booth being sprayed with adhesive 30 in preparation for applying fabric to the panels.

Next, the assembled panel 10 and design pieces 21-28 are placed in a spray booth beneath spray nozzles 52 and coated with adhesive 30 as depicted in FIG. 10. A thin flexible layer 40 (e.g., fabric) is then applied over the assembled panel 10 and design pieces 21-28. For example, this step can be done by moving the panel assembly to a suction table 50 (as shown in FIG. 11), placing fabric 40 over the assembled panel 10 and design pieces 21-28, and then drawing down the fabric 40 by suction through the panel 10.

Optionally, a layer of air-impermeable flexible material 45 (e.g., a thin plastic or vinyl sheet) can be temporarily placed over the fabric 40 to assist in drawing the fabric 40 into close contact with panel assembly and the adhesive layer. The air-impermeable layer is then removed, while leaving the fabric layer 40 in place to bond with the adhesive 30. This temporary air-impermeable layer is more likely to be needed if the fabric layer 40 is loosely woven or very air-permeable. FIG. 11 is a perspective view showing the panel assembly placed on a suction table 50 with a fabric layer 40 and an air-impermeable cover layer 45 being drawn down by suction down over the panel 10 and design pieces 21-28.

Figure 11:
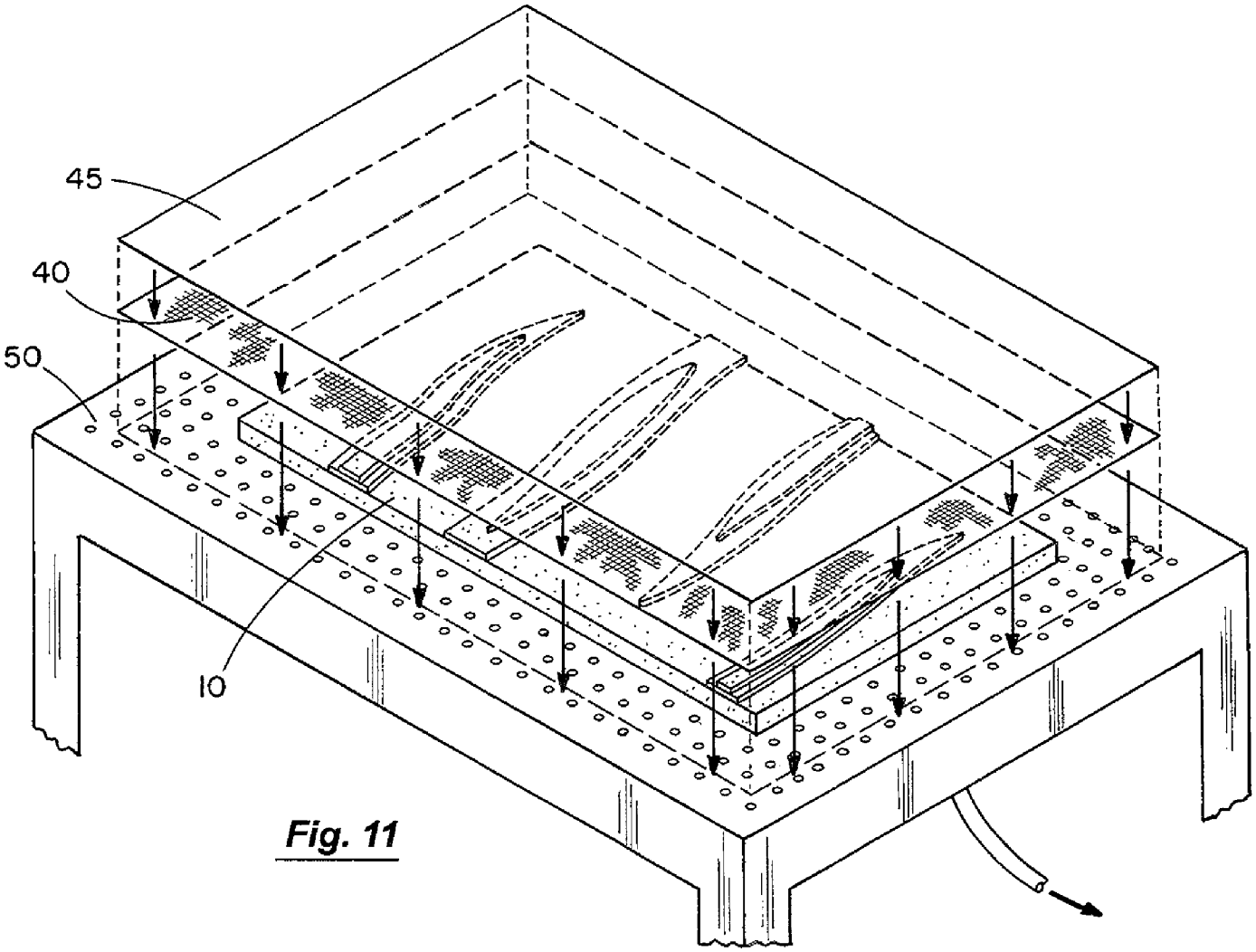
FIG. 11 is a perspective view showing the panel 10 placed on a vacuum table 50 with a fabric layer 40 and an air-impermeable cover layer 45 being drawn down by suction down over the acoustical panel 10 and design pieces 21-28.
Figure 12:
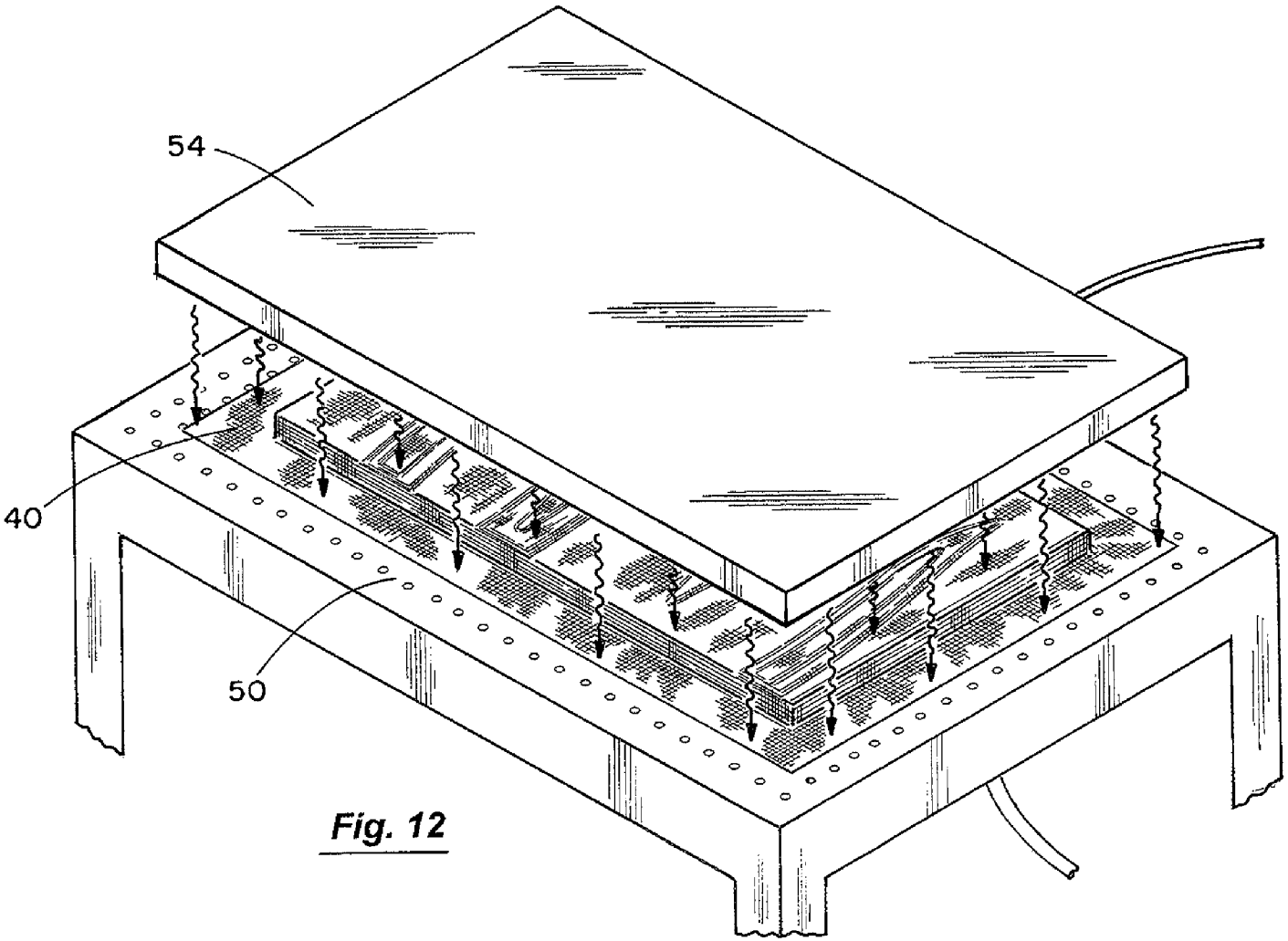
FIG. 12 is a perspective view showing a heat machine 54 placed over the panel assembly in FIG. 11 to further the curing process.
Figure 13:
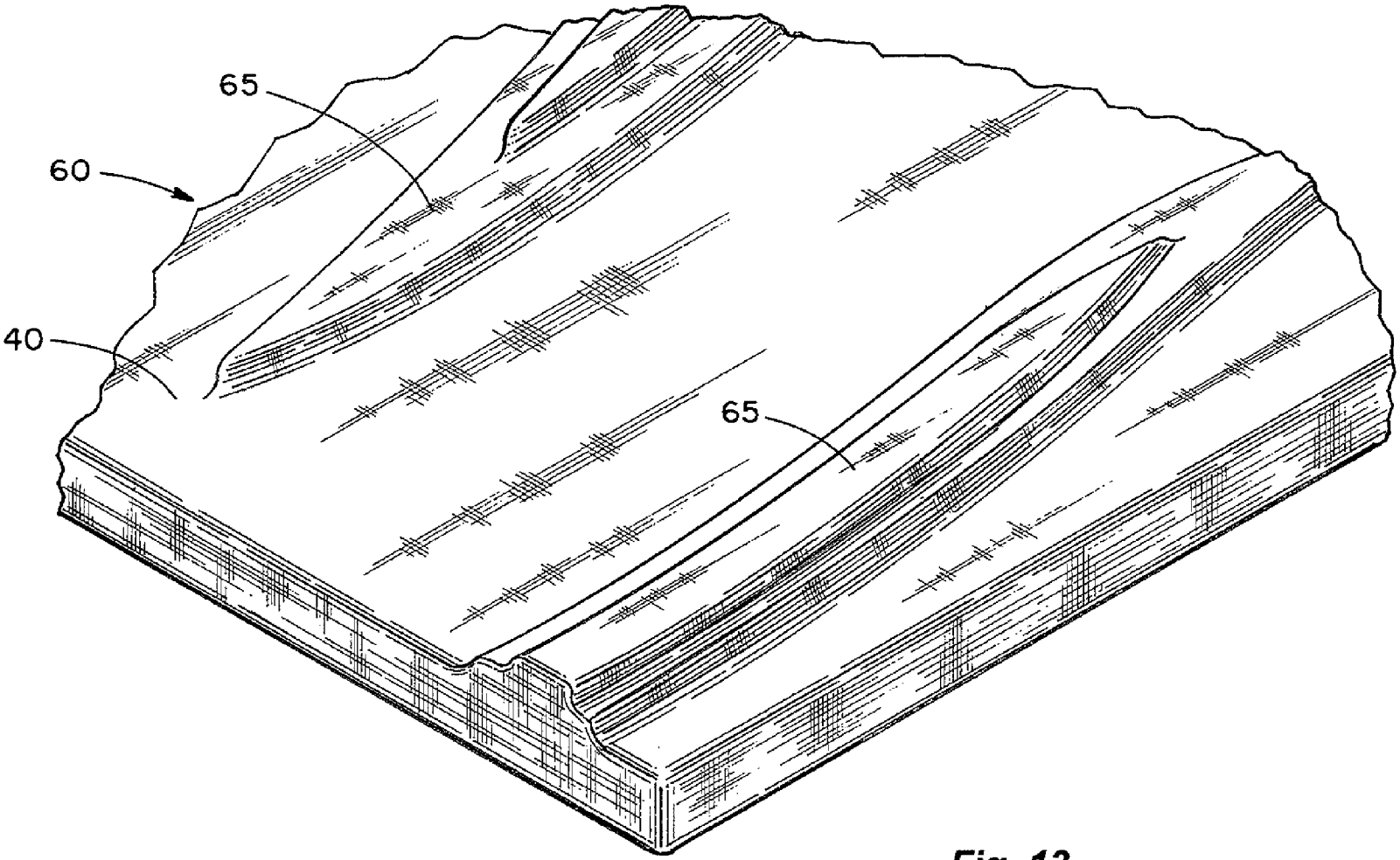
FIG. 13 is a detail perspective view of a portion of a finished panel 60 showing the fabric layer 40 folded around the edge of the panel and formed over the design pieces.

FIG. 12 is a perspective view showing a heat machine 54 placed over the panel assembly in FIG. 11 to further curing of the adhesive 30. This step may be optional depending on the adhesive selected. Finally, FIG. 13 is a detail perspective view of a portion of a finished panel showing the fabric 40 folded around the edge of the panel and formed over the design pieces to complete the assembly.

Figure 14:
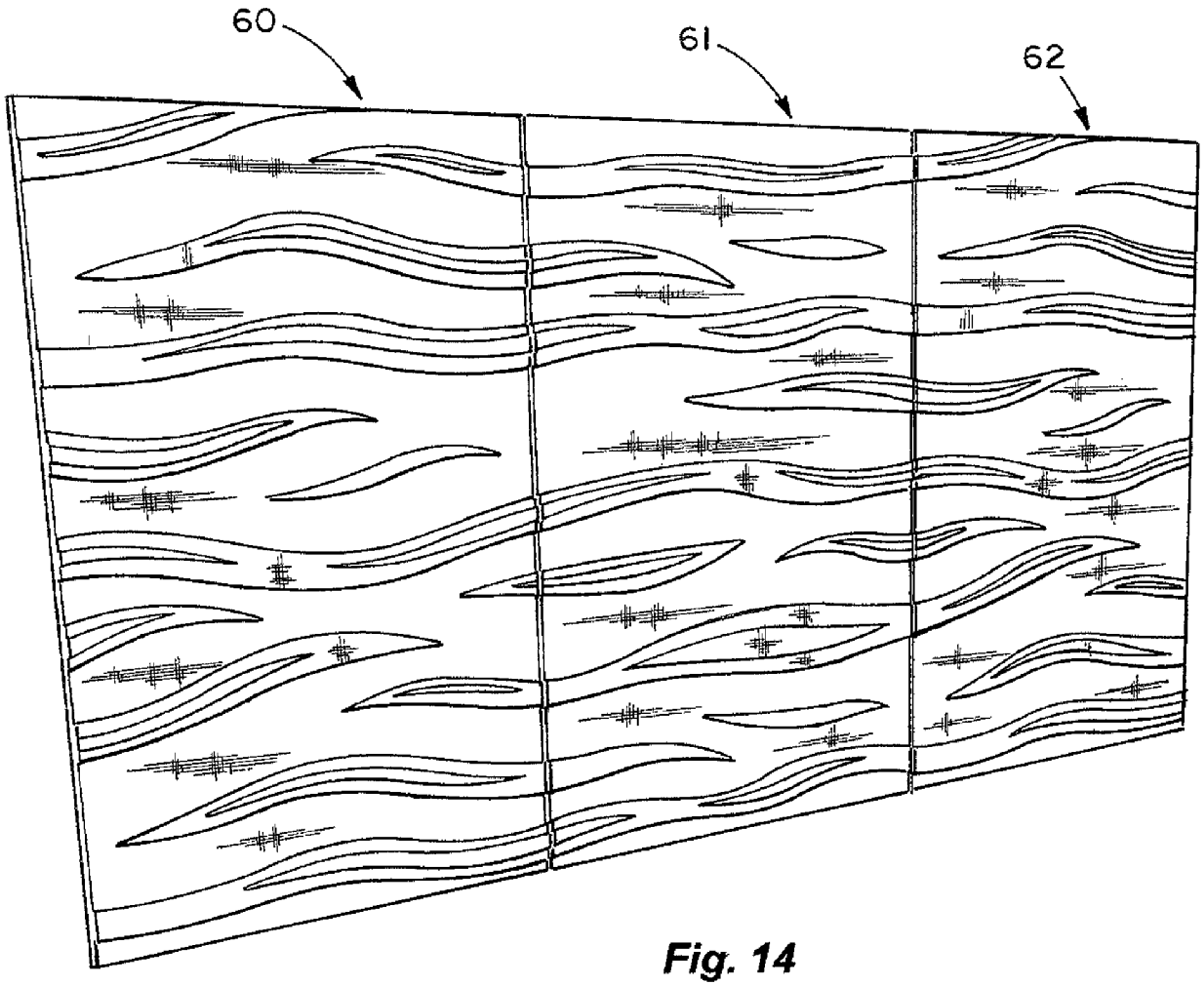
FIG. 14 is a perspective view of three panels 60-62 assembled together showing how designs 65 can be continuous from one panel to the next.

It should be understood that virtually any desired three-dimensional design can be created on a panel 10 by employing the present invention. The designs can be limited to a single panel or a particular region of a panel. Alternatively, FIG. 14 illustrates a series of panels 60, 61 and 62 assembled together showing designs 65 that span multiple panels.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. A method for making an acoustical panel with a three-dimensional surface comprising:

providing an acoustical panel having a substantially flat surface;

forming design pieces;

attaching the design pieces to the surface of the panel to create three-dimensional designs;

applying adhesive to the design pieces and surface of the panel;

placing an air-permeable, thin flexible layer over the design pieces and panel;

placing an air-impermeable layer over the thin flexible layer;

drawing air through the panel to suck the thin flexible layer and air-impermeable layer against the design pieces and surface of the panel; and removing the air-impermeable layer, while leaving the thin flexible layer to bond with the adhesive.

2. The method of claim 1 wherein the thin flexible layer comprises fabric.

3. The method of claim 1 wherein acoustical panel is air-permeable.

4. The method of claim 3 wherein the acoustical panel comprises fiberglass.

5. The method of claim 1 further comprising applying a hardening material to the edges of the acoustical panel prior to bonding the thin flexible layer.

6. The method of claim 1 further comprising attaching reinforcing material to the edges of the acoustical panel prior to bonding the thin flexible layer.

7. The method of claim 1 wherein a plurality of flat design pieces are stacked to create the three-dimensional design.

* * * * *